US010442999B2

(12) United States Patent
Gull

(10) Patent No.: US 10,442,999 B2
(45) Date of Patent: Oct. 15, 2019

(54) RADIANT TUBE SUPPORT SYSTEM FOR FIRED HEATERS

(71) Applicant: BIRWELCO USA Inc., Houston, TX (US)

(72) Inventor: Walter F Gull, Hockley, TX (US)

(73) Assignee: Birwelco USA Inc., Houston, TX (US)

( * ) Notice: Subject to any disclaimer, the term of this patent is extended or adjusted under 35 U.S.C. 154(b) by 0 days.

(21) Appl. No.: 15/564,355

(22) PCT Filed: Apr. 12, 2016

(86) PCT No.: PCT/US2016/027122
§ 371 (c)(1),
(2) Date: Oct. 4, 2017

(87) PCT Pub. No.: WO2016/168191
PCT Pub. Date: Oct. 20, 2016

(65) Prior Publication Data

US 2018/0127661 A1 May 10, 2018

Related U.S. Application Data

(60) Provisional application No. 62/146,795, filed on Apr. 13, 2015.

(51) Int. Cl.

| | |
|---|---|
| ***F22B 37/20*** | (2006.01) |
| ***C10G 9/20*** | (2006.01) |
| ***F27D 99/00*** | (2010.01) |
| ***F28F 9/013*** | (2006.01) |
| *F28D 7/02* | (2006.01) |
| *F28D 7/08* | (2006.01) |
| *F28D 21/00* | (2006.01) |

(52) U.S. Cl.
CPC ..... *C10G 9/20* (2013.01); *F22B 37/203* (2013.01); *F27D 99/0003* (2013.01); *F27D 99/0035* (2013.01); *F28F 9/0131* (2013.01); *F28F 9/0132* (2013.01); *F27D 2099/0045* (2013.01); *F27D 2099/0056* (2013.01); *F28D 7/024* (2013.01); *F28D 7/085* (2013.01); *F28D 21/001* (2013.01)

(58) Field of Classification Search
CPC ..... F22B 37/203
See application file for complete search history.

(56) References Cited

U.S. PATENT DOCUMENTS 1,787,038 A * 12/1930 Geoffray ..... F24D 19/02 248/233
1,815,750 A * 7/1931 Watts ..... F23M 5/06 122/510
1,883,123 A * 10/1932 Trainer ..... F22D 1/06 122/510
2,175,555 A 10/1939 Brown
(Continued)

OTHER PUBLICATIONS

International Search Report and Written Opinion in PCT/US16/27122, dated Jul. 15, 2016.
(Continued)

*Primary Examiner* — Nathaniel Herzfeld
(74) *Attorney, Agent, or Firm* — Blank Rome LLP

(57) ABSTRACT

Apparatus and methods are described for novel radiant tube coil support designs that are insertable through holes in the casing walls of fired heaters from the outside of the heater.

15 Claims, 9 Drawing Sheets

(56) References Cited

U.S. PATENT DOCUMENTS

| | | | | | |
|---|---|---|---|---|---|
| 2,355,800 | A * | 8/1944 | Hensel | C10G 9/20 | 122/510 |
| 2,834,327 | A * | 5/1958 | Banker | F22B 37/10 | 122/510 |
| 2,852,219 | A * | 9/1958 | Perkins | F16L 3/227 | 248/68.1 |
| 3,554,168 | A | 1/1971 | Woebcke | | |
| 3,599,914 | A * | 8/1971 | Stephens | F22B 37/204 | 122/510 |
| 3,844,515 | A * | 10/1974 | Knol | F22B 37/20 | 122/510 |
| 4,706,614 | A | 11/1987 | Fournier | | |
| 4,986,222 | A * | 1/1991 | Pickell | C10G 49/002 | 110/336 |
| 5,799,623 | A * | 9/1998 | Born | F22B 37/203 | 122/493 |
| 6,047,929 | A * | 4/2000 | Kaji | F27D 1/145 | 122/510 |
| 6,178,926 | B1 | 1/2001 | Worman | | |
| 2004/0124075 | A1* | 7/2004 | Nogueira, Jr. | C10G 9/20 | 202/124 |

OTHER PUBLICATIONS

International Search Report and Written Opinion issued in counterpart European Application No. 16780563.9 dated Nov. 20, 2018.

* cited by examiner

Prior Art

Prior Art

SECTION B - B'

RADIANT TUBE SUPPORT SYSTEM FOR FIRED HEATERS

CROSS REFERENCE TO RELATED APPLICATIONS

This application claims priority based on U.S. Provisional Application Ser. No. 62/146,795 filed Apr. 13, 2015, which is incorporated herein by reference in its entirety.

FIELD OF THE INVENTION

This invention relates generally to apparatus and methods for the design, retrofitting and repair of supports for the multiplicity of radiant tubes that convey organic materials to be heated in industrial fired heaters.

BACKGROUND OF THE INVENTION

Without limiting the scope of the invention, its background is described in connection with existing radiant tube supports for industrial direct fired heaters or furnaces. Fired heaters are central to the processes required for the operation of oil refineries and the design of such heaters must conform to API 560. Fired heaters are also used in chemical and petrochemical processes to induce chemical reactions within the organic materials and are typically referred to as industrial fired furnaces. A fired heater typically consists of a radiant section, radiant coil, burners and a flue gas stack, and can also incorporate a convection section with coil, forced draft and/or induced draft fans or combustion air preheat. Each individual heater is designed to transfer a defined amount of heat to the coils at a certain rate, based on the volume and rate of organic material running through the coils all at a specified efficiency.

Depending on the chemical process, such heaters operate in the temperature range from 400° C. to over 1000° C. As depicted in FIGS. 1A-D, such heaters will generally include a radiant section 20 or firebox where heat is transferred from burner elements typically arrayed along a floor or side wall of the heater radiant section to organic materials that are conveyed in a continuous path through a multiplicity of radiant tube coils 22. The interior walls of the heater casing are lined (protected) with ceramic fiber insulation or castable refractory lining 30, which is designed to reduce heat loss, radiate heat back toward the back (shadowed) side of the tube coils and to keep the temperatures of the casing as designed. For efficiency purposes, the heaters will typically include a convection section 10 where heat is transferred to the conveyed organics in convection coils 12 through the process of convective heat transfer as heated flue gases rise out of the firebox, through the convection section and up and out a flue gas stack 15. Heater designs include those with horizontal radiant tubular coils and vertical radiant tubular coils. The radiant tubular coils can receive radiant heat from one side (single fired) or from both sides (double fired). The four most common heat designs utilizing single fired radiant tubes include vertical cylindrical helical coil fired heaters (FIG. 1A), vertical cylindrical vertical coil fired heaters (FIG. 1B), horizontal tube cabin (box) fired heaters (FIG. 1C), and horizontal tube twin cell (box) fired heaters (FIG. 1D).

Regardless of the configuration, the severe operating conditions required by the design include high operating temperatures that adversely affect the constituent metals of the entire internal aspects of the heater including by oxidation, creep, stress fracturing and thermal cycling during start up and shut down operations. The radiant tubes are further affected by the chemicals conveyed within them and deposits thereof including corrosion, erosion, metal dusting and coke deposition on the inner walls of the tubes. Coke deposits can result in elevated tube metal temperatures, leading to carburization and metal dusting of steel tubing, affect heat flow through each tube and the entire coil. Internal corrosion in the tube coils results from the combined effects of the chemical composition of the process fluid, process and tube metal temperatures, fluid velocity and tube metallurgy. Fortunately the radiant tubes can be inspected by several non-destructive techniques including by smart pigging, boroscoping, magnetic testing of austenitic tubes, ultrasonic testing, infrared inspection and by eddy current analysis, among others.

In fired heaters the radiant tubes are typically supported by radiant tube coil supports 24 (also termed hangers or hooks) that are generally bolted or clipped to the interior walls and roof of the heater. Due to the weight that they support, the radiant tube supports are generally bolted through the heater casing into structural support columns or beams 26 along the sides or roof, exterior to the heater casing. Insulation is installed throughout the interior of the heater radiant firebox, convection section, and typically the stack. The radiant tube supports hold the radiant coils in position by supporting and guiding the tubes and are designed to minimize sagging, bowing and buckling of the tubes and to keep the coil stable without swaying and within acceptable stress limits while allowing for the free expansion of the tubes of the coil during startup and shutdown of the heater. The coils are generally hung a distance off of the insulation interior surface (hot face) of the heater to reduce shadowing of the back side of the coil tubes, increasing heat transfer to the tube through improved radiation. The radiant tube supports are individually designed such that as a whole a plurality of supports will carry a vertical load that includes the weight of the tube and fitting components of the entire coil, the contents of the coil (fluid or gas), and the horizontal frictional load experienced when the coils expand/contract upon the heater being started/shutdown.

An example of a radiant tube support in use in the industry is shown in FIGS. 2A-C in top, side elevation and sectional views. The supports are typically of solid construction, consisting of an integral cast base 36 with holes 34 that are utilized to allow attachment to the firebox inner wall (by bolting through the wall). Typically, existing supports such as that depicted in FIG. 2A-C, include an arm portion 38 upon which the radiant tube 22 rests. The arm portion typically has a "T", "I" or "[" cross section (consisting of a central web and a upper and or lower flange). The radiant tube supports are bolted from the inside of the radiant firebox to the inside of the casing wall 32 in uniform rows, spaced a distance apart, that distance being dependent upon size of tube being supported, and as dictated by applicable codes and specifications. Integral in the design in many of the radiant tube hook supports are keepers, a device that is intended to further guide the tube during operation, reducing the possibility of the tube lifting up and off of the support during heater operation. These keepers 42 typically consist of a separate cast pin of circular or rectangular cross-section that can be inserted vertically in a hole or slot to restrict the tube movement vertically and or horizontally. These keepers can attached to a single tube support hook or several depending upon the design. Tube supports such as those depicted in FIGS. 2A-C include an integral cast shoulder 44 that together with the keeper, control the lateral position of the tube coil on the support.

Radiant tube supports are made from heat resistant alloys chosen for high-temperature strength, creep properties, and resistance to corrosion. Typically, radiant tube supports are cast out of high nickel chrome alloy material capable of resisting the elevated temperatures experienced inside the radiant firebox enclosure. Nonetheless, the tube supports are susceptible to high temperature oxidation, high temperature embrittlement, thermal fatigue, stress fracturing and mechanical damage from thermal cycling during operations as well as corrosion from fuel ash and other combustion products. Tube hangers and supports fail for several reasons including elevated stress, long term creep, mechanical damage from vibration or expansion and mechanical impact during cleaning, corrosion, metallurgic changes over time, and poor quality castings.

As is clear from FIGS. 1A-D, a large number of tube supports are utilized to support the radiant tube coils. These supports are critical to the function of the heater because failure of one or more of the tube supports allows for sagging of the radiant coils or movement of the tube into the burner flames and may lead to catastrophic failure of the entire heater if the tube coils fail during operation. Current tube supports can only be inspected or changed out when the heater is non-operational. Changing out of a tube support is done from the interior of the heater because the tube supports are bolted through the heater casing from the interior of the heater. When replacement of tube supports are required, the supports must often be ordered as custom casting or fabrications with significant delay in supply because most industrial direct fired heaters are custom one off designs. As the different processes within an oil refinery or chemical plant cannot operate if the heater is out of service, any down time for the heaters will significantly affect the economics of the overall plant.

From the foregoing it is apparent there is a need in the art for improved tube supports that can be inspected and replaced during operation of the heater as well as tube supports that are universally adaptable for different heater designs. The invention described provides novel radiant tube supports that may be tested for integrity and replaced during heater operation and further provides a tube support system that may be retrofitted or replaced on existing heaters of varying designs while they remain in service.

BRIEF SUMMARY OF THE INVENTION

The present invention is directed to novel radiant coil supports that are insertable from outside of the firebox and will fit heaters having different refractory lining thicknesses. Methods of repair and installation of such supports are provided. In one embodiment, a radiant tube coil support system for fired heaters is provided that includes a support mounting frame adapted to be mounted on an external surface of a heater casing and a plurality of tube supports that are mounted to the heater casing from the external surface of the heater casing, wherein each tube support system includes a heater casing internal section termed a tube support that supports the weight of the radiant coil. In certain embodiments the tube support includes one or more voids that are cast into the tube support. In certain embodiments, the voids are ventable to an exterior of the heater casing. The voids reduce the weight of the tube support and allow sampling of gases or pressure from an interior of the support to allow for external monitoring for cracks in the tube supports.

In certain embodiments, the radiant tube coil support system further includes a plurality of tube keepers wherein each keeper that is adapted and dimensioned for placement over an upward surface of at least one individual tube support and the tube keeper together with the tube support surround over one-half of an outer circumference of the radiant tube and control movement of the radiant tube. The keeper may include one or more voids that are ventable to an exterior of the heater casing. Sampling of gases or pressure from an interior of the keeper allows for external monitoring for cracks in the keepers.

Both the tube support and the tube keeper are insertable from the external surface of the heater. In one embodiment, both the tube support and the tube keeper include an external shoulder that remains outside of the heater casing.

In certain embodiments, depth control spacers are utilized to abut the external shoulder and control a depth that the tube support can enter into an interior of the heater casing. In certain embodiments a locking mechanism that is mounted on the support frame controls outward movement of the tube support. In other embodiments, the tube support and tube keeper are held together by close fitting in passage through a hole in a retainer plate and external shoulders of the tube support and tube keeper that do not pass through the hole in the retainer plate are sandwiched between the retainer plate and the base plate, wherein the tube support and tube keeper together with the retainer plate and base plate form a unitary support system that act to sandwich the tube support and tube keeper together as they are installed around a radiant tube.

In other embodiments, the tube supports and tube keepers can be locked together at the base and attached to the support frame through the use of a clamp type fixture consisting of a base plate and retainer plated bolted together. In certain embodiments, the tube supports include an upwardly curved distal end dimensioned to cradle a radiant tube and a tube keeper is utilized that covers at least a portion of an upper aspect of a radiant coil such that the tube support and tube keeper together prevent the radiant coil from bending, falling, or otherwise leaving the support.

BRIEF DESCRIPTION OF THE DRAWINGS

For a more complete understanding of the present invention, including features and advantages, reference is now made to the detailed description of the invention along with the accompanying figures.

DETAILED DESCRIPTION OF THE INVENTION

Figure 1A:
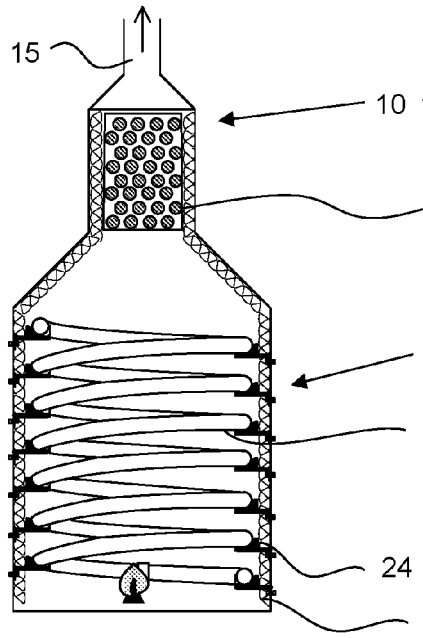
FIG. 1A illustrates the general design of existing vertical cylindrical helical coil fired heaters.
Figure 1B:
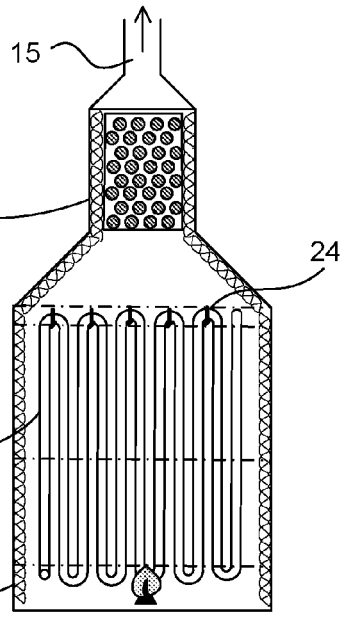
Prior Art Fig. 1B
FIG. 1B illustrates the general design of existing vertical cylindrical vertical coil fired heaters.
Figure 1C:
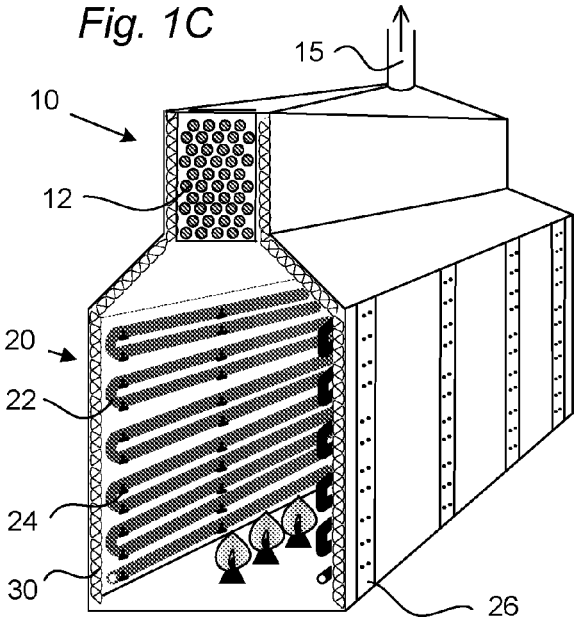
Prior Art Fig. 1C
FIG. 1C illustrates the general design of existing horizontal tube cabin (box) fired heaters.
Figure 1D:
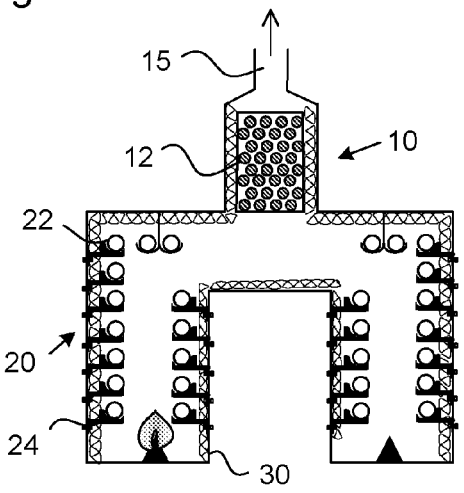
Prior Art Fig. 1D
FIG. 1D illustrates the general design of existing horizontal tube dual cell (box) fired heaters.
Figure 2A:
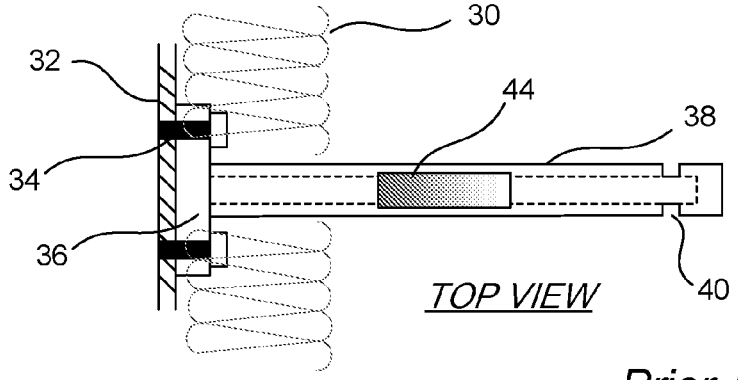
FIGS. 2A-C illustrate the general design of an exemplary prior art radiant tube coil support in top, side and sectional views.
Figure 2B:
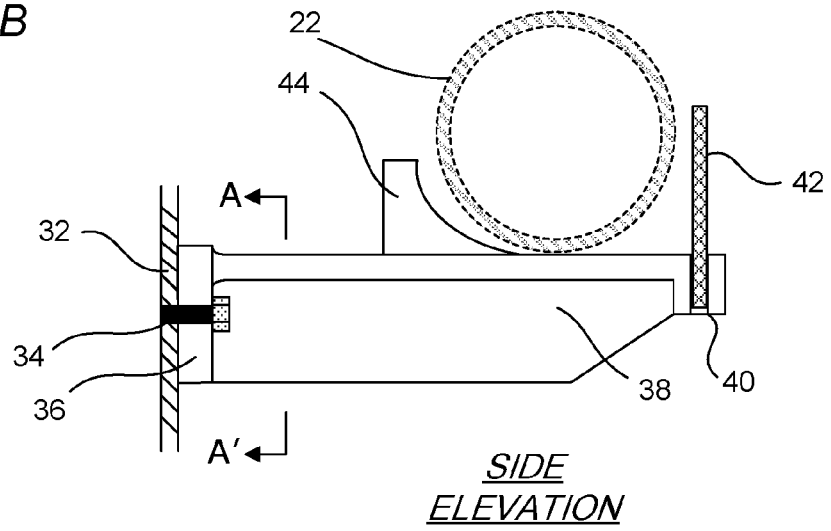
Prior Art Fig. 2B
Figure 2C:
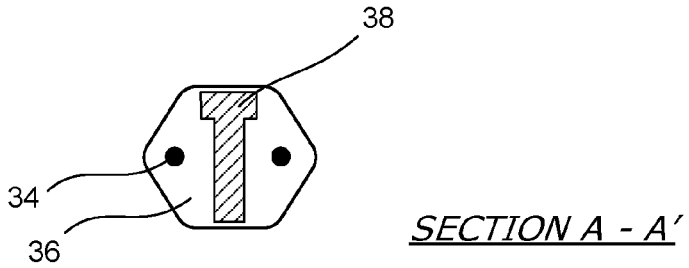
Prior Art Fig. 2C

While the making and using of various embodiments of the present invention are discussed in detail below, it should be appreciated that the present invention provides many applicable inventive concepts which can be employed in a wide variety of specific contexts. The specific embodiment discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Provided herein are various embodiments of novel radiant tube coil support designs that are insertable through holes in the casing walls of the heater from the outside of the heater in contrast to existing designs that are bolted to the inside of the heater casing. Due to the combined tapered and smooth outer profile of the tube supports and any included keeper, the interior heater insulation may be better applied by tight fitting to the tube support and any included keeper such that the overall effectiveness of the insulation and long-term performance of the insulation are improved. In certain embodiments, the radiant tube support attachment locations are moved off of the heater structural columns where they are typically attached in prior art designs. This allows a uniform application of the insulation system across the locations of the structural support columns and provides improved protection of the structural columns from exposure to excessive temperatures as a result of premature failure of the insulation system.

Because the supports are inserted from the outside of the heater they can be replaced while the heater remains in service. In one embodiment, the tube support design allows for use in different heater designs that share the same radiant coil tube outside diameter but have different insulation thicknesses and different distances between the radiant coil tube centerline and the hot face of the insulation system. This feature makes it economically feasible to have spare supports on hand as they can be used in multiple heaters.

The radiant tube coil support designs provided herein feature an increased bearing surface for supporting and guiding of the radiant tube coils and together with the keeper described herein, the combined support system provides improved restraint of the radiant tube coil without over stressing or damaging the tube coils.

In certain embodiments, radiant tube supports and keepers are provided that are cast or fabricated to include hollow voids that have vents to the outside of the heater and allow for one or more of: 1) ventilation of the radiant tube coil supports allowing them to run at a cooler temperatures during operation and thus improving their functional lives; 2) accurate temperature measurements of the tube supports during operation; 3) through continuous or intermittent monitoring of products of combustion and/or internal negative pressure (draft) through the support and keeper vents (if a keeper is included), cracks in the tube supports and tube keepers can be identified from outside the heater during operation; and 4) improved distribution of the high alloy metal thus improving the strength to weight ratio. In one embodiment, the radiant tube supports disclosed herein are designed with external depth control spacers to accommodate minimal vertical rotation in its base, providing support/restraint to allow for some tube vertical movement during operation, the flexibility intending to reduce additional stresses in the coil tubes.

The following examples are include for the sake of completeness of disclosure and to illustrate the methods of making the compositions and composites of the present invention as well as to present certain characteristics of the compositions. In no way are these examples intended to limit the scope or teaching of this disclosure.

EXAMPLE 1

Radiant Tube Coil Support and Keeper Profile

Figure 3A:
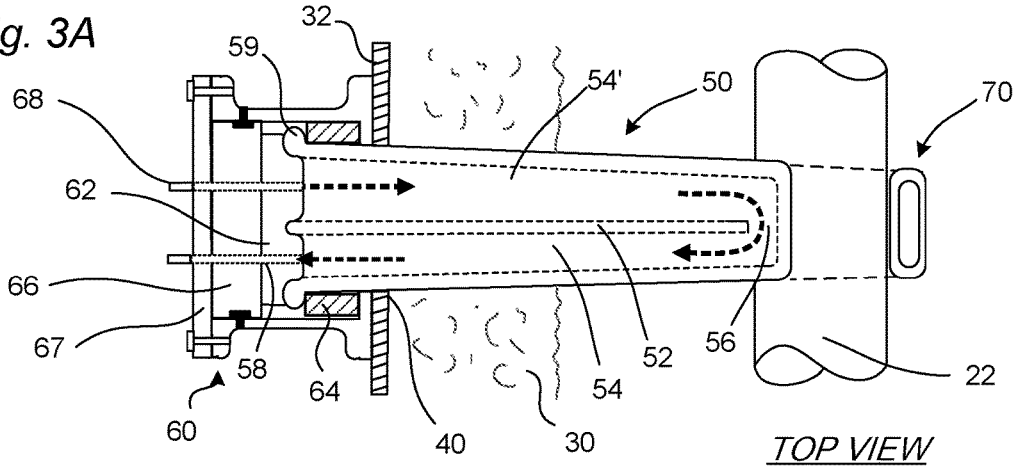
FIGS. 3A-C illustrate the design of one embodiment of a radiant tube coil support in accordance with the present invention in top, side and sectional views.
Figure 3B:
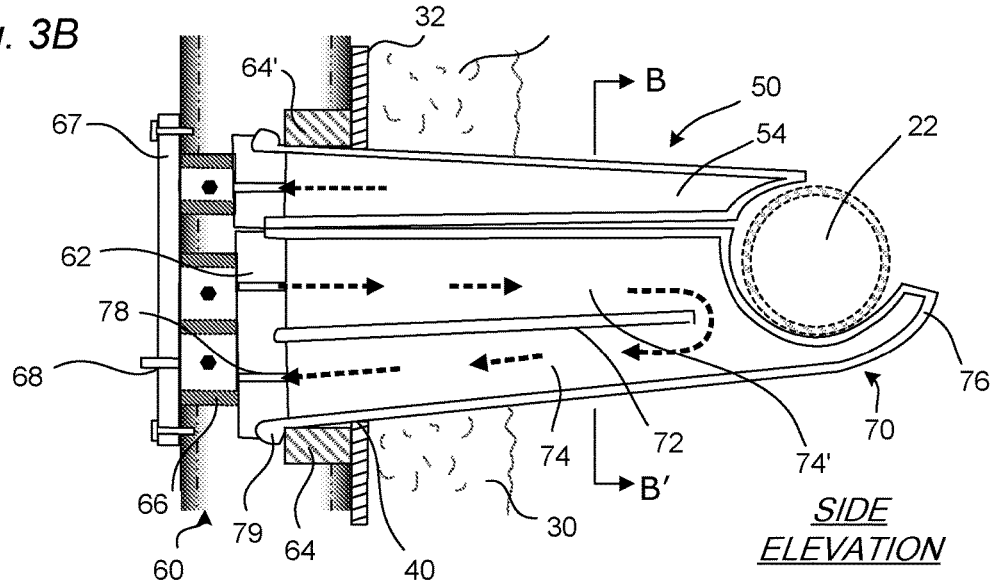
Figure 3C:
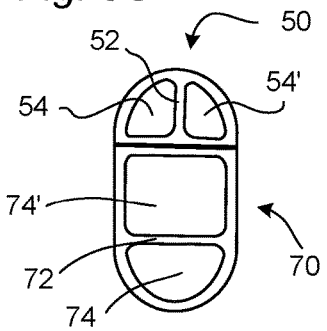

One embodiment of a radiant tube coil support and tube keeper according to the invention is depicted in FIGS. 3A-C. In contrast to prior art radiant tube coil supports that are bolted to the casing wall from an interior surface of the heater casing, in the embodiment of the invention shown in the top view of FIG. 3A and side view of FIG. 3B, the radiant tube coil support 70 and tube keeper 50 are inserted from the outside of heater casing 32 through to the inside of the heater casing through generally oblong casing hole 40 and a similarly oblong hole or void in insulation 30. In certain embodiments, the hole in the casing through which the tube support or tube support/keeper combination is inserted is cut to closely approximate the outside dimensions of the tube support or tube support/keeper combination and limit escape of heat and gases from inside the heater during operation.

Tube keeper 50 is fabricated, or preferably cast, with one or more internal voids 54. In the depicted embodiment, tube keeper 50 has two interior voids 54 and 54' separated by vertical internal support wall 52. In the depicted embodiment allowing for a circulation path through the keeper body, support wall 52 does not extend the full length of the keeper body and thus a communication 56 is provided between void 54 and 54'. The void or voids 54 are vented to the outside of the heater casing 32 through one or more keeper vents 58. The entire radiant tube coil support system is held in place by support mounting frame assembly 60, which is welded to the outside of heater casing 32. Support mounting frame consists of a frame that attaches such as via welding to the heater casing from the exterior, and provides for removable access plates 66 that serve to complete the enclosure, creating a seal that minimizes the ingress of ambient air during operation.

Figure 4A:
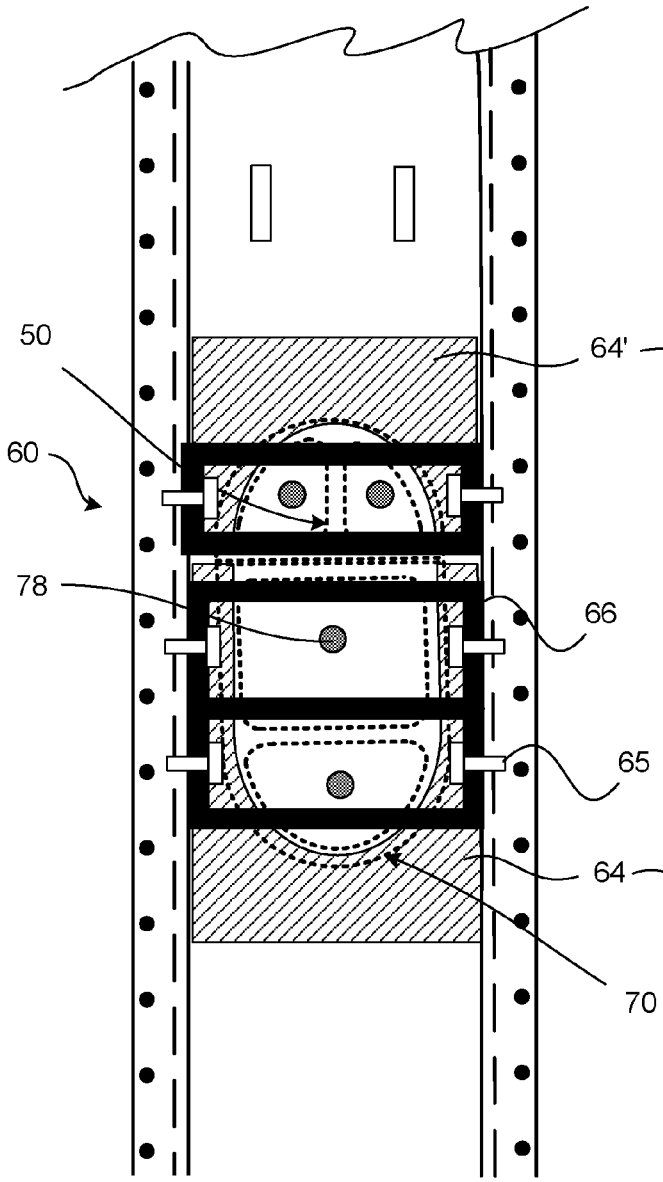
FIG. 4 illustrates the design of a support mounting frame capable of being closed and sealed, external to a heater casing in accordance with one embodiment of a radiant tube coil support system.

In the embodiment shown in FIG. 3A, the depth that tube keeper 50 is able to enter into the heater casing is controllable by depth control spacers 64 that are inserted after tube support 70 and tube keeper 50 are inserted. The depth control spacers 64 are positioned on the outside of the heater casing within frame assembly 60. As shown in FIG. 3A, tube keeper depth control spacer 64 controls the inward motion of the tube keeper by virtue of tube keeper shoulders 59 that abut the depth control spacer 64 to one side and to frame assembly 60 on the other side as shown in FIG. 4A. As shown in FIG. 3B, tube support depth control spacer 64'controls the inward motion of tube support 70 by virtue of tube support shoulders 79 that abut the depth control spacer 64' to one side and to frame assembly 60 on the other side as shown in FIG. 4A. As shown on FIGS. 3A and 3B, end caps 62 cap the voids of the tube support (and tube keeper if employed) and cooperate with locking frame 66 to control the outward motion of tube support 70 and keeper 50 (if employed). Locking frame 66 is bolted via bolts 65 to frame assembly 60. Through the use of different depth control spacers, the radiant tube coil supports are adaptable to different heater designs with the inward length of the support determined by the overall thickness of the insulation and the desired standoff of the radiant tube from the insulation hot face. Depth control spacers may be provided as solid fabricated spacers of various standard thicknesses or may be custom cast. In an alternative embodiment, the depth control spacers are provided as a standard relatively thin thickness and the desired distance that the keeper and tube support are able to extend into the heater interior is obtained by stacking a plurality of depth control spacers.

Figure 3D:
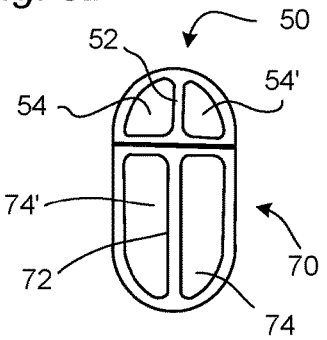
FIG. 3D illustrates one embodiment of a tube support with a vertical internal wall or column.

FIG. 3B provides a side view of tube keeper 50 as it operates together with tube support 70 to partially surround and control the movement of radiant tube coil 22. As depicted, the combined tube support 70 and tube keeper 50 project into the interior of the heater through hole 40 in casing 32 and further through a similar sized hole or void in insulation 30. In the depicted embodiment, the most distal end of tube support 70 features an upturned lip and cradles pipe 22. In certain embodiments, tube support 70 includes an internal structural support 72 that may run vertically (as shown in FIG. 3C) or horizontally (as shown in FIG. 3D) partially through the tube support but permitting gaseous communication through one or more voids 74. In the depicted embodiment, which allows for a circulation path through the body of tube support 70, internal structural support 72 bisects tube support 70 producing upper void 74' and lower void 74. In alterative embodiments, the internal supports may be a plurality of columns. The void or voids 74 are vented to the outside of the heater casing 32 through one or more tube support vents 78 and keeper vents 58, which communicate with outer vents 68, which if desired may be formed in access plate 67, which is also bolted to support frame 60. Alternatively, access plate 67 may be solid and access to tube support vents 78 and keeper vents 58 is obtained by removing access plate 67.

Samples of gases from the interior of keeper 50 or the interior of the support 70 may be obtained through sample ports 68, which are in gaseous communication with tube support vents 78 and keeper vents 58. If keeper 50 or tube support 70 is cracked, combustion gases will be detectable in samples taken from sample port 68. Alternatively or in addition, pressure readings may be taken of the gases within keeper 50 or support 70 with reduced pressures expected in the event of cracks in tube keeper 50 or tube support 70.

Figure 4B:
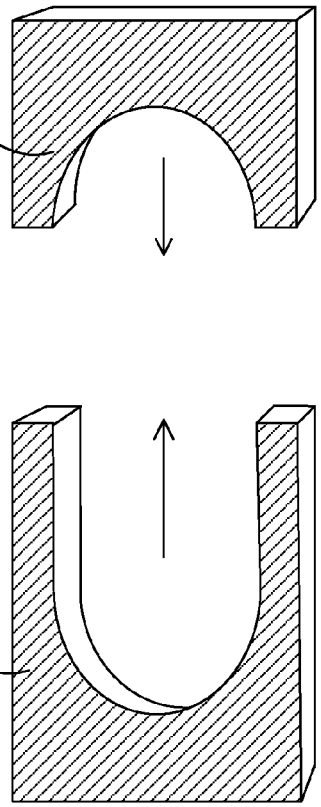

Installation specifics. With the frame assembly 60 installed, such as by welding at the desired position on the heater casing, oval openings are cut in the casing and through the insulation. The tube support is then inserted through the opening at an angle, allowing for proper positioning of the hook at the tip of the tube support with the tube. Due to the size of the insertion hole, the tube support is insertable at a downward angle from horizontal angle and can get below the lowest aspect of the radiant tube without disturbing the placement of the tube. After insertion past the deepest aspect of the radiant tube, the support is raised to a more horizontal position. This is followed by insertion of the keeper, which slides into position, filling the oval hole and locking the tube support and tube keeper in position. In certain embodiments, depth control spacers 64 are then installed in position. As shown in the embodiment depicted in FIG. 4B, the depth control spacers are slid into position around the shoulders of the tube support (and keeper if utilized or plug if no keeper is employed) and the depth control spacers control the depth that the tube support and tube keeper can enter into the interior of the heater. End cap 62 is installed over the ends of the tube support, and tube keeper if included, by bolting locking frame to the side walls of frame assembly 60. The entire frame assembly is then enclosed and sealed by removable access plates 67. Installation process is the same for new heaters or for existing heaters.

Figure 5:
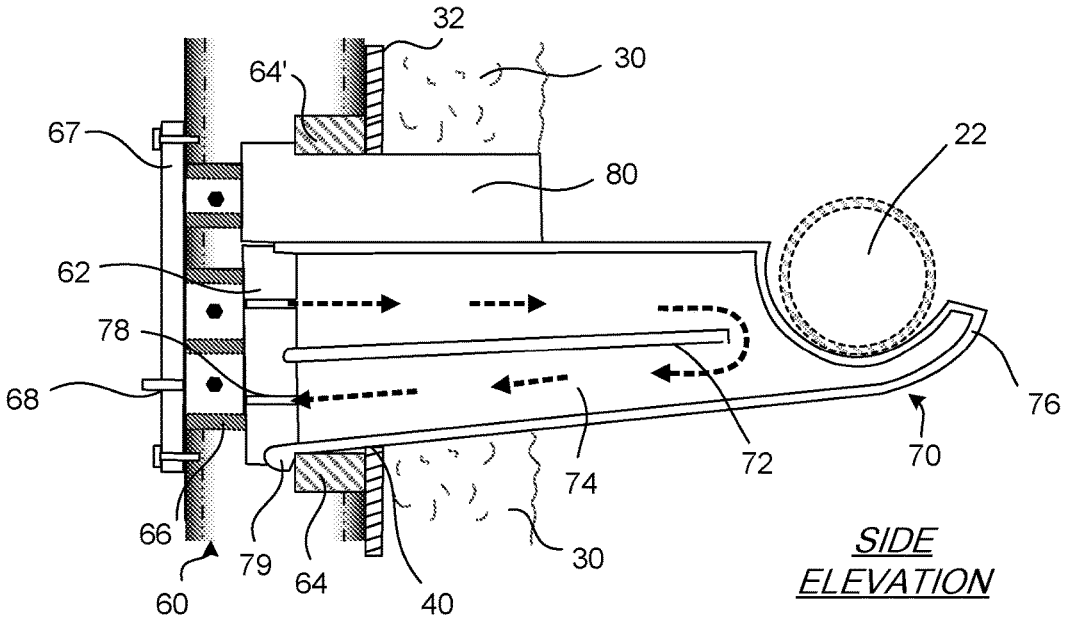
FIG. 5 illustrates the design of a radiant tube coil support system utilized without a keeper.

In certain alternative embodiments as generally depicted in FIG. 5, a tube support is utilized without a tube keeper. In such events, the extra space in the casing hole that would otherwise be filled with a tube keeper and which is used to insert the tube support at an angle need to come under and up to cradling the radiant tube 22, is filled with plug 80, which is generally dimensioned like the proximal end of a respective tube keeper and is inserted after the tube support is inserted. With this implementation as shown in FIG. 5, where the tube keeper is replaced with a plug, all of the other parts can be standard to those implementations designed for use with a tube keeper. In certain embodiments the outer part of the plug that fits in and through the hole in the casing is metal and the interior part of the plug is an insulating material.

EXAMPLE 2

Unitized Tube Support and Keeper System

Figure 6A:
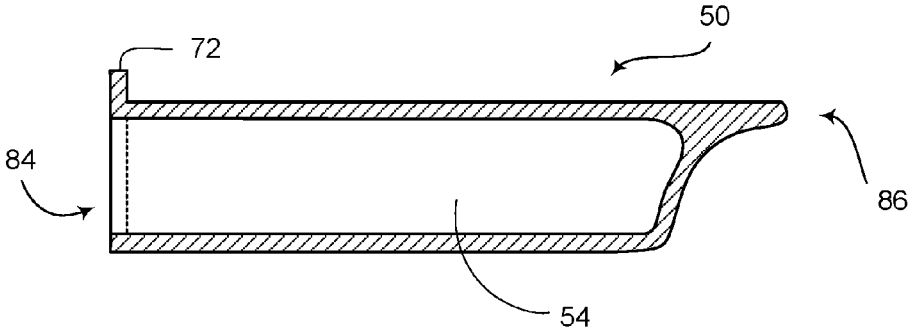
FIG. 6A illustrates a side section of one embodiment of a tube keeper.
Figure 6B:
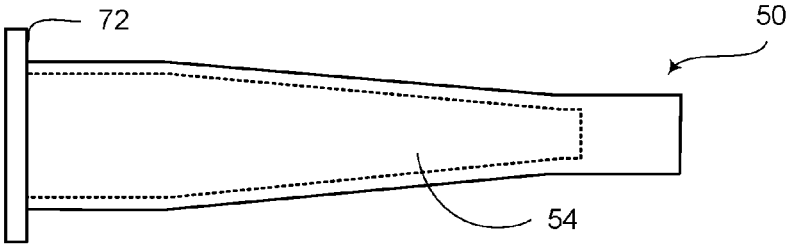
FIG. 6B illustrates a top-down view of the embodiment of FIG. 6A.

FIG. 6A provides a side section view of another embodiment of a tube keeper 50. In one embodiment, tube keeper 50 is cast with an internal void section 54. Proximal end 84 of the tube keeper 50 is the end that extends through the heater wall and includes shoulders 72 that insure that the tube keeper cannot fall into the heater. Distal end 86 of the tube keeper is dimensioned to extend partially over a top aspect of a radiant coil (not shown) to help keep it in place. FIG. 6B provides a top down section view of the embodiment of FIG. 6A.

Figure 6C:
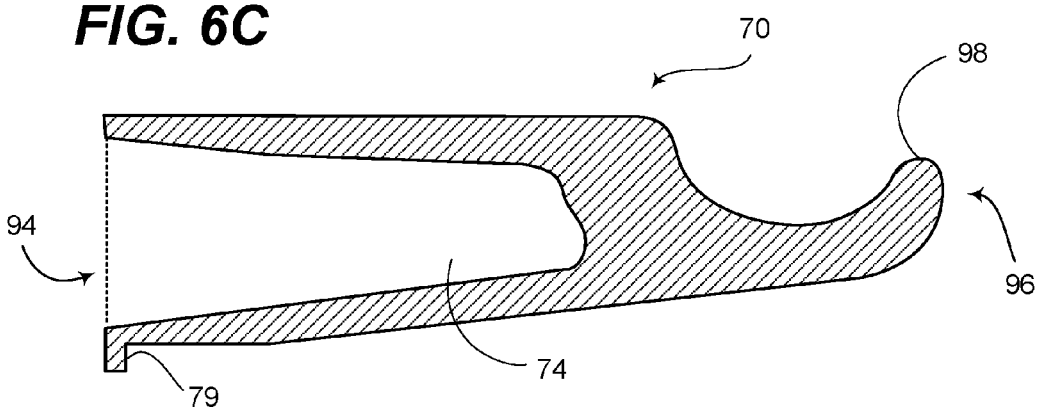
FIG. 6C illustrates a side section of one embodiment of a tube support.
Figure 6D:
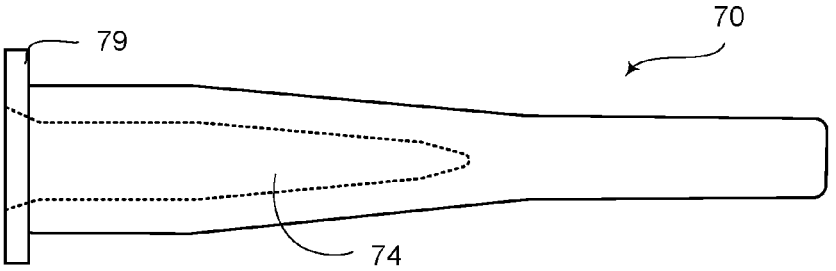
FIG. 6D illustrates a top-down view of the embodiment of FIG. 6C.

FIG. 6C provides a side section view of another embodiment of a tube support 70. In one embodiment, tube support 70 is cast with an internal void section 74. Proximal end 94 of the tube support 70 is the end that extends through the heater wall and includes shoulders 79 that insure that the tube support cannot fall into the heater. Distal end 96 of the tube support is dimensioned to partially cradle a bottom aspect of a radiant coil (not shown) and includes lip 98 that, together with the distal aspect of the tube keeper, keep the radiant coil in place on the support. FIG. 6D provides a top down section view of the embodiment of FIG. 6C.

Figure 7A:
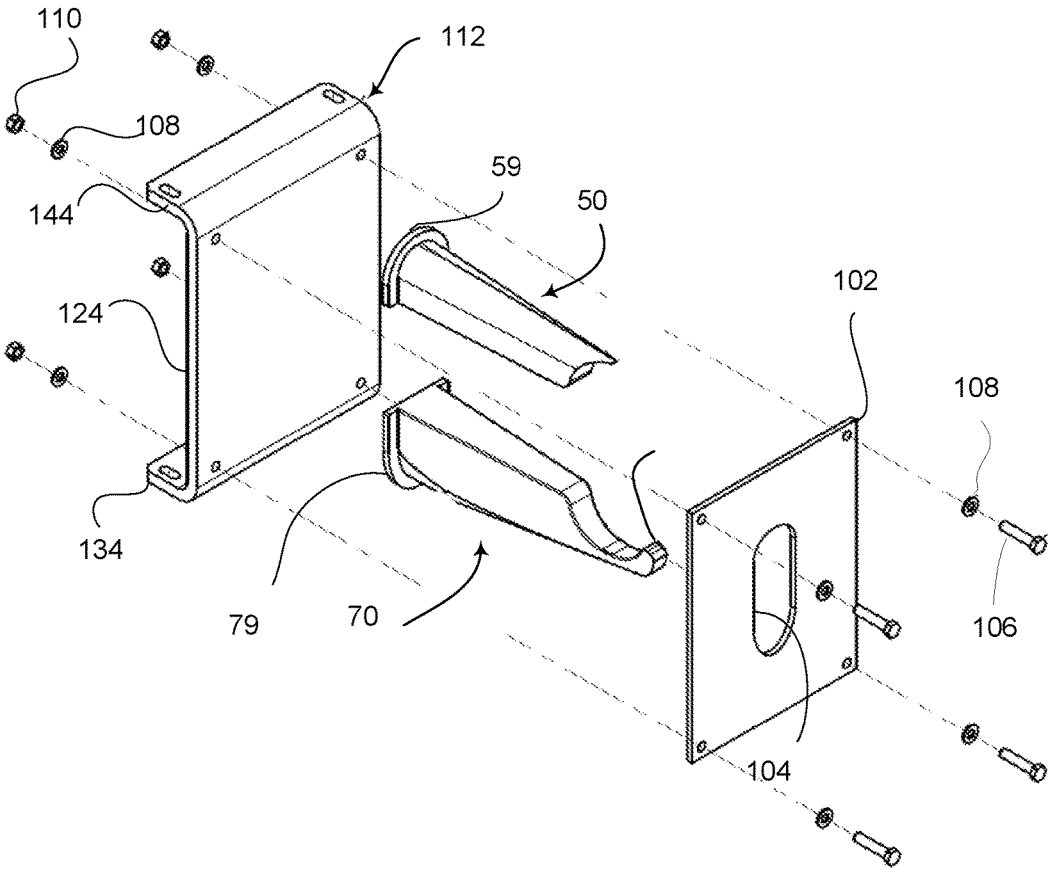
FIG. 7A illustrates an exploded view of one embodiment of a tube support and tube keeper and their relation to a retainer and base plate.
Figure 7B:
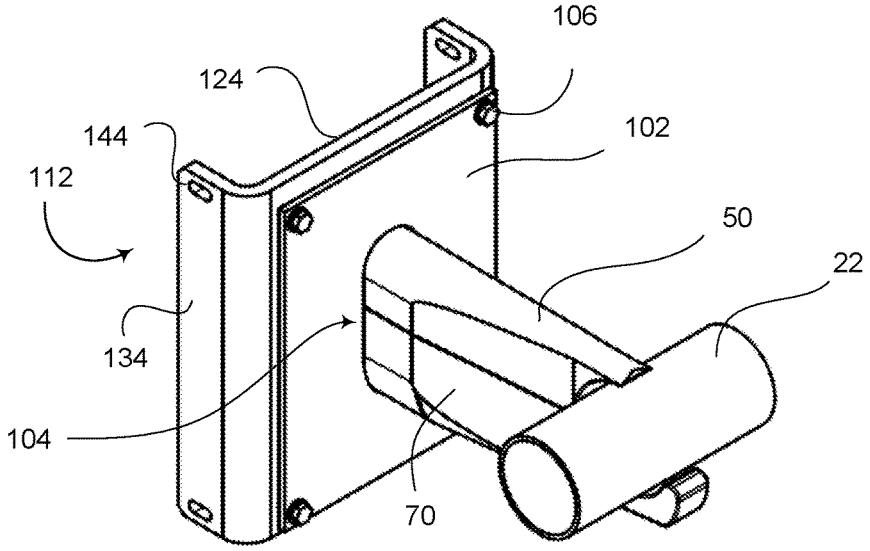
FIG. 7B illustrates an assembled view of the embodiment of FIG. 7A.
Figure 8A:
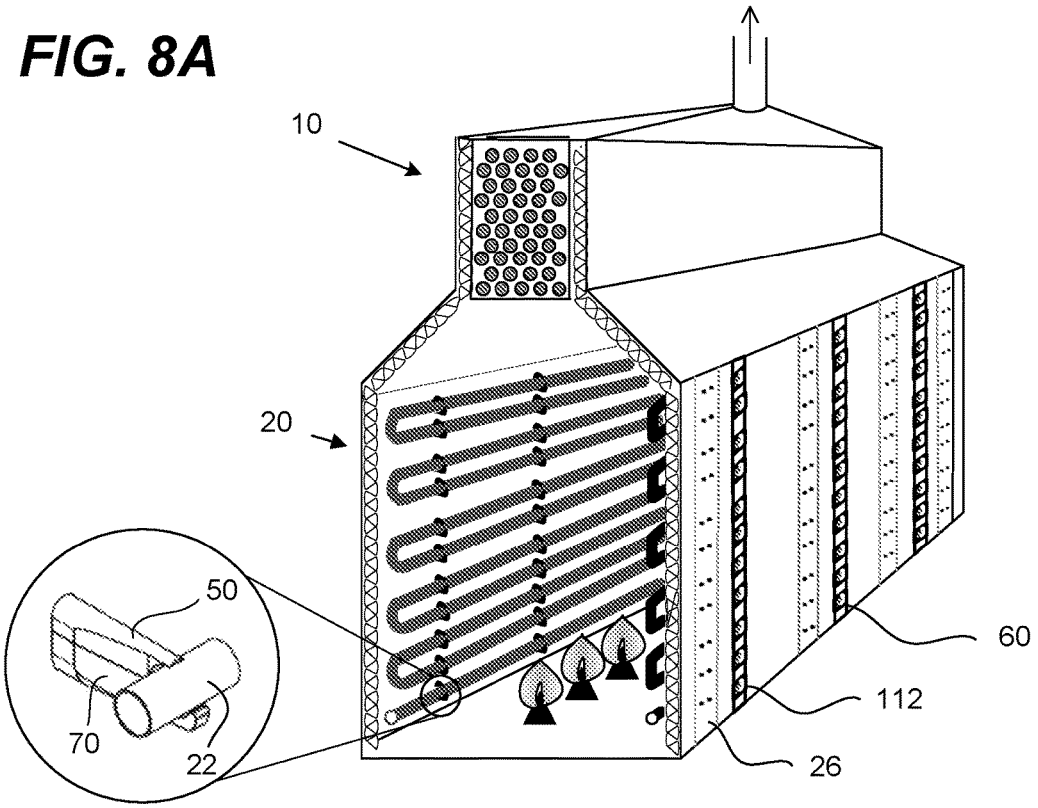
FIG. 8A depicts an embodiment wherein support frame assemblies are affixed vertically on the outside of the heater casing.
Figure 8B:
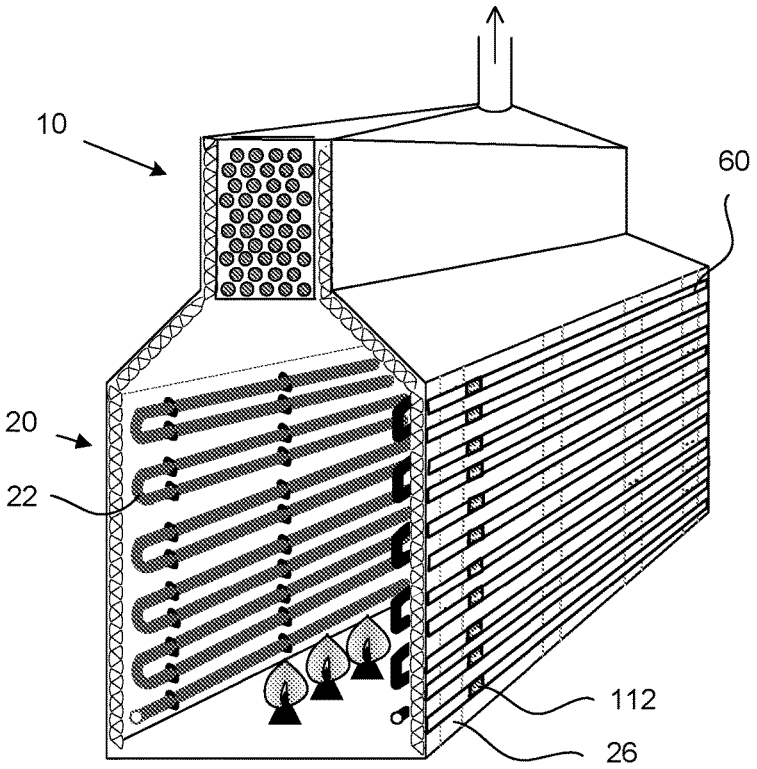
FIG. 8B depicts an embodiment wherein support frame assemblies are affixed horizontally on the outside of the heater casing.

In FIG. 7A, an exploded view is provided of another embodiment utilizing the tube support and tube keeper of FIGS. 6A-D in a unitized system. As depicted tube keeper 50 and tube support 70 are dimensioned to pass through hole 104 of retainer plate 102. Shoulder 59 of tube keeper 50 and shoulder 79 of tube support 70 abut the back of retainer plate 102 and prevent the combined tube keeper and support from passing completely through the retainer plate. Retainer plate 102 is affixed to wall 124 of base plate bracket 112 with through attachments such as bolts 106 that can be tightened with nuts 110, including optional washers 108. In FIG. 7B, the embodiment of FIG. 7A is shown assembled and surrounding a radiant coil 22. However, in FIG. 7A base plate bracket 112 is oriented with attachment extensions 134 extending from the top and bottom of the bracket 112 while in FIG. 7B the base plate 112 is oriented with attachment extensions 134 extending from each side of the bracket 112. The attachment extensions 134 include holes 144 for passage of mounting bolts or screws. The orientation of the base plate bracket is determined depending on whether the support frame assemblies 60 are affixed vertically (as depicted in FIG. 8A) or horizontally (as depicted in FIG. 8B) on the outside of the heater casing. In FIG. 8B only one column of base plate brackets 112 is shown but in the depicted embodiment there will be one bracket for each tube support.

Figure 7C:
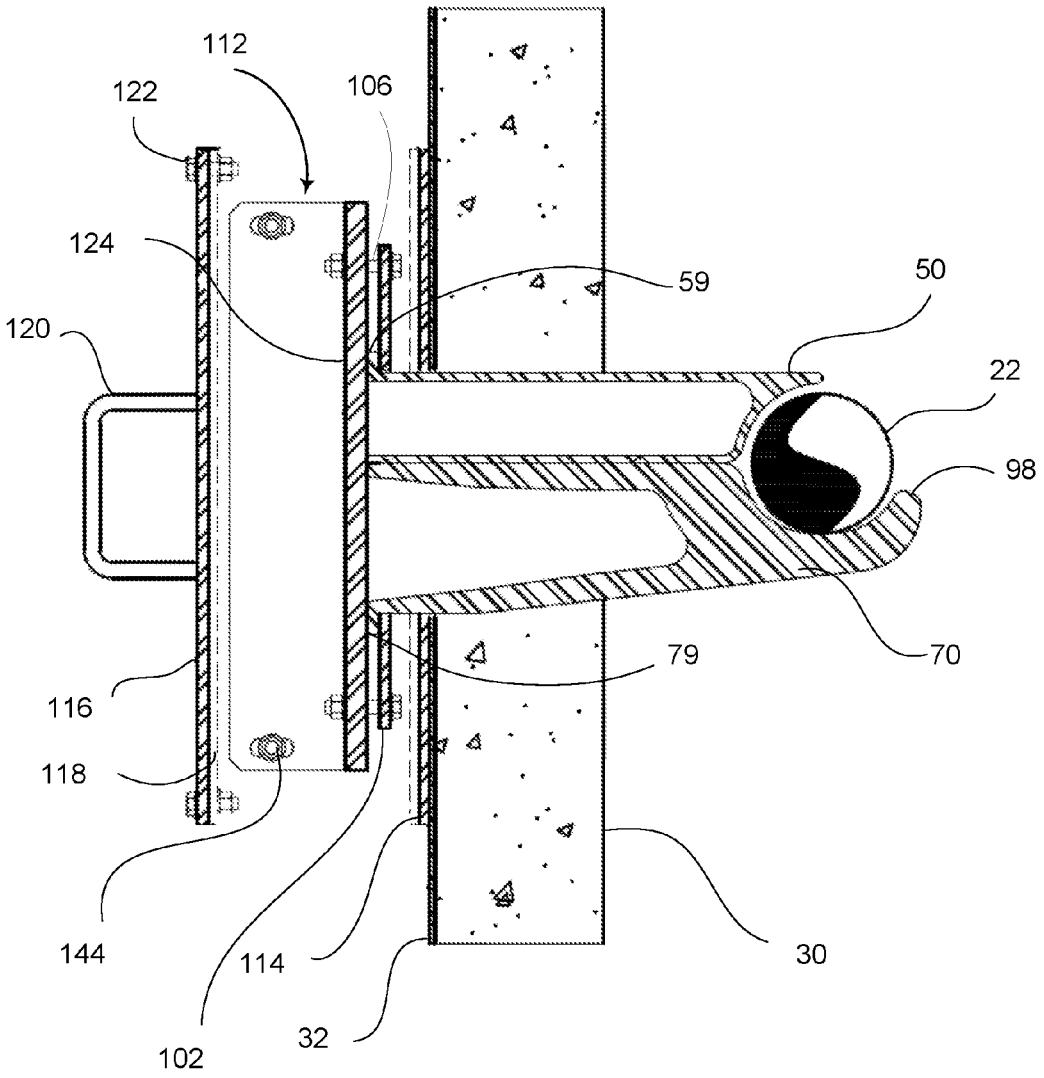
FIG. 7C illustrates an installation section view of the embodiment of FIGS. 7A and 7B mounted on a furnace wall.

In FIG. 7C, an assembled view is provided of an embodiment that includes the unitized tube support assembly of FIGS. 7A and B in position on heater casing 32. As depicted tube support 70 cradles radiant coil 22 while tube keeper 50 insures that the coil cannot be dislodged from the support. Tube keeper 50 and tube support 70 extend from an exterior to the furnace through an opening in casing 32 and project into an interior of the furnace through insulation 30 to hold the radiant coil 22. The tube support system may include a backplate 114 to cover the hole in the furnace casing during manipulations. Tube support 70 and tube keeper 50 are held together by retainer plate 102 that is bolted to wall 124 of base plate bracket 112. The support assembly is covered by enclosure plate 116 that may include an inner gasket 118. Handle 120 may be affixed enclosure plate 116. In the depicted embodiment of FIG. 7C, the orientation of base plate bracket 112 is for mounting to vertical support frames (not shown but seen as element 60 in FIG. 8A). In one embodiment, a plurality of unitized tube support assemblies are affixed to a support mounting frame adapted to be mounted on an external surface of a heater casing and the plurality of unitary tube supports are inserted into the interior of the heat from the external surface of the heater casing.

For installation oval openings are cut in the heater casing 32 and through insulation 30. Retainer plate 102 is placed in position such that its central hole (104 on FIG. 7A) lines up with the hole cut in the heater casing. Tube support 70 is then inserted through the retainer plate and casing hole opening at an angle, allowing for proper positioning of the hook or lip 98 at the distal end of tube support 70 with the radiant coil tube 22. Due to the size of the insertion hole, the tube support is insertable at a downward angle from horizontal angle and can get below the lowest aspect of the radiant tube without disturbing the placement of the tube. After insertion past the deepest aspect of the radiant tube, the support is raised to a more horizontal position. This is followed by insertion of the tube keeper 50, which slides into position, filling the generally oval hole in the retainer plate and casing hole. Base plate bracket 112 is then bolted to retaining plate 102 via bolt or screw 106 and is further bolted to the support frame via holes 144 locking tube support 70 and tube keeper 50 in position. The support assembly is covered by enclosure plate 116 that may include an inner gasket 118 which are affixed to the support frame (not shown). The installation process is the same for new heaters or for existing heaters.

EXAMPLE 3

Radiant Tube Coil Integrity Testing Using Tube Supports During Plant Operation

In another embodiment, the tube support is adapted to measure the load of the tube resting on it. During operation the load of the tube is transferred to the tube support and keeper. With the load tube support and keeper being transferred to the heater structure through the depth control spacers, load gauges can be installed between the depth control spacers and the frame assembly to measure the loading of the tube supports by the tubes, capturing any weigh changes during operation attributable to coking of the tubes, tube carburization over time or thermal expansion issues.

All publications, patents and patent applications cited herein are hereby incorporated by reference as if set forth in their entirety herein. While this invention has been described with reference to illustrative embodiments, this description is not intended to be construed in a limiting sense. Various modifications and combinations of illustrative embodiments, as well as other embodiments of the invention, will be apparent to persons skilled in the art upon reference to the description. It is therefore intended that the appended claims encompass such modifications and enhancements.

We claim:

1. A radiant tube coil support system for fired heaters comprising:

a support mounting frame adapted to be mounted on an external surface of a heater casing, and at least one tube support that is mounted to the support mounting frame, wherein the tube support includes a tube support internal section that is insertable from the external surface of the heater through a hole in the heater casing into an interior of the heater and a tube support external section that includes an external shoulder that remains outside of the hole in the heater casing, wherein each tube support comprises one or more voids that are in gaseous communication via vents to an exterior monitoring access plate for each tube support on exterior of the heater casing whereby monitoring of a status of each tube support is obtainable during operation of the fired heater.

2. The radiant tube coil support system for fired heaters of claim 1, wherein the heater casing internal section of the tube support includes an upwardly curved distal end dimensioned to cradle a radiant tube disposed along an interior wall of the heater.

3. The radiant tube coil support system for fired heaters of claim 1, wherein wherein the monitoring of the status of the individual tube supports is selected from one or more of monitoring temperature, monitoring products of combustion, and monitoring internal negative pressure.

4. The radiant tube coil support system for fired heaters of claim 1 further comprising:

a depth control spacer that abuts the external shoulder and controls a depth that the tube support can enter into the interior of the heater, and a locking frame that is mounted on the support frame and controls outward movement of the tube support.

5. The radiant tube coil support system for fired heaters of claim 2, further comprising a tube keeper that is adapted and dimensioned for placement over an upward aspect of the tube support, wherein the tube keeper includes a tube keeper internal section that is insertable from the external surface of the heater through the hole in the casing into the interior of the heater and a tube keeper external section that includes an external shoulder that remains outside of the hole in the heater casing.

6. The radiant tube coil support system for fired heaters of claim 5, wherein the tube keeper together with the tube support surround over one-half of an outer circumference of the radiant tube and control movement of the radiant tube.

7. The radiant tube coil support system for fired heaters of claim 5, wherein each tube keeper comprises one or more voids that are ventable to an exterior of the heater casing.

8. The radiant tube coil support system for fired heaters of claim 5, further comprising a retainer plate adapted for placement on the external surface of the heater casing and having a central hole that is dimensioned for passage of the tube support and the tube keeper partially through the retainer plate and into the interior of the heater while preventing passage of the external shoulders of the tube support and tube keeper through the central hole of the retainer plate.

9. The radiant tube coil support system for fired heaters of claim 8, further comprising a base plate bracket that is adapted and dimensioned to be affixed to the retainer plate after the tube support and tube keeper are inserted through the retainer plate.

10. The radiant tube coil support system for fired heaters of claim 9, wherein the base plate bracket is adapted to be affixed to the support mounting frame mounted on an external surface of the heater casing.

11. The radiant tube coil support system for fired heaters of claim 1 wherein the tube support and the tube keeper are cast to include the one or more voids.

12. A radiant tube coil support system for fired heaters comprising:

at least one tube support that includes a tube support internal section that is insertable through a heater casing from an exterior of the fired heater into an interior of the fired heater and a tube support external section that includes an external shoulder that remains outside of the heater casing;

at least one tube keeper for each tube support, each tube keeper including a tube keeper internal section that is insertable through the heater casing from the exterior of the fired heater into the interior of the fired heater and a tube keeper external section that includes an external shoulder that remains outside of the heater casing, wherein the tube keeper is adapted and dimensioned for placement over an upward surface of the tube support such that the tube keeper together with the tube support surround over one-half of an outer circumference of a radiant tube disposed along an interior wall of the fired heater and control movement of the radiant tube, wherein each tube support and tube keeper comprises one or more voids that are in gaseous communication via vents to an exterior monitoring access plate for each tube support and tube keeper on an exterior of the heater casing whereby monitoring of a status of individual tube supports is obtainable during operation of the fired heater.

13. The radiant tube coil support system for fired heaters of claim 12, further comprising a retainer plate adapted for placement on an external surface of the heater casing and having a central hole that is dimensioned for passage of the tube support and the tube keeper partially through the retainer plate and into the interior of the heater while preventing passage of the external shoulders of the tube support and tube keeper through the central hole of the retainer plate.

14. The radiant tube coil support system for fired heaters of claim 13, further comprising a base plate bracket that is adapted and dimensioned to be affixed to the retainer plate after the tube support and tube keeper are inserted through the retainer plate.

15. The radiant tube coil support system for fired heaters of claim 14, wherein the base plate bracket is adapted to be affixed to a support mounting frame mounted on an external surface of the heater.

* * * * *